US005576095A

United States Patent [19]

Ueda et al.

[11] Patent Number: 5,576,095

[45] Date of Patent: Nov. 19, 1996

[54] WATER AND OIL REPELLENT FIBER COMPRISING A PHYSICALLY INCORPORATED PERFLUOROPOLYETHER

[75] Inventors: Akihiko Ueda; Seiji Takubo, both of Settsu; Yoshio Amimoto, Osaka, all of Japan

[73] Assignee: Daikin Industries, Ltd., Osaka, Japan

[21] Appl. No.: 449,117

[22] Filed: May 24, 1995

Related U.S. Application Data

[63] Continuation of Ser. No. 167,797, filed as PCT/JP93/00520, Apr. 22, 1993, published as WO93/22483, Nov. 11, 1993 abandoned.

[30] Foreign Application Priority Data

Apr. 23, 1992 [JP] Japan ..... 4-104348
Jan. 22, 1993 [JP] Japan ..... 5-009062

[51] Int. Cl.[6] ..... D01F 6/92; D06M 15/277; D06M 15/233; D03D 3/00

[52] U.S. Cl. ..... 428/224; 428/284; 428/364; 428/903; 428/913

[58] Field of Search ..... 428/224, 284, 428/903, 913, 364

[56] References Cited

U.S. PATENT DOCUMENTS

| | | | |
|---|---|---|---|
| 4,182,846 | 1/1980 | Saegusa et al. | 528/341 |
| 4,250,300 | 2/1981 | Saegusa et al. | 528/401 |
| 4,563,493 | 1/1986 | Fukui et al. | 524/233 |
| 5,300,357 | 4/1994 | Gardiner | 428/224 |

FOREIGN PATENT DOCUMENTS

| | | |
|---|---|---|
| 60-215813 | 10/1985 | Japan . |
| 02026919 | 1/1990 | Japan . |
| 02269877 | 11/1990 | Japan . |

*Primary Examiner*—Frederick Krass
*Attorney, Agent, or Firm*—Birch, Stewart, Kolasch & Birch, LLP

[57] ABSTRACT

A water- and oil-repellent fiber formed from a synthetic resin composition which contains a fluorine-containing polymer having a repeating unit (a) having a perfluoroalkyl or perfluoroalkenyl group and an ether linkage gives a fabric having excellent water- and oil-repellency, excellent stain resistance and excellent feeling.

15 Claims, No Drawings

WATER AND OIL REPELLENT FIBER COMPRISING A PHYSICALLY INCORPORATED PERFLUOROPOLYETHER

This application is a continuation of application Ser. No. 08/167,797, filed as PCT/JP93/00520, Apr. 22, 1993 published as WO93/22483, Nov. 11, 1993, now abandoned.

FIELD OF THE INVENTION

The present invention relates to a synthetic fiber having water- and oil-repellency.

RELATED ART

The following working methods for make a fiber or fabric (including a non-woven fabric) water- and oil-repellent are mentioned:

(1) A method which comprises incorporating a water- and oil-repellent into a fiber during the spinning of the fiber, (2) A method which comprises coating a water- and oil-repellent on a fiber by a dipping and the like after the spinning of the fiber (cf., for example, Japanese Patent Kokai Publication No. 46123/1983 and Japanese Patent Kokai Publication No. 94621/1984), and (3) A method which comprises coating a water- and oil-repellent on a fabric (for example, a woven fabric formed by weaving fibers and a non-woven fabric formed by making a web) by a dipping, a spraying and the like.

However, the methods (2) and (3) have the following disadvantages. In the method (2), the fibers are subjected to various mechanical forces during the step of weaving the fibers for making the fabric so that the coating film of the water- and oil repellent is peeled off from the fiber and the fabric often has low water- and oil-repellency. The method (3) is generally conducted. In the method (3), because the water- and oil-repellent is only coated on the fabric, the coating film is peeled off from the fabric by a washing, a friction and the like so that the water- and oil repellency can not continue for a long time.

The method (1) seems to have the advantage that the water- and oil-repellency continues for a long time. However, the water- and oil-repellent which exhibits the sufficient water- and oil-repellency has not been found yet.

SUMMARY OF THE INVENTION

An object of the present invention is to provide a fiber which has the sufficient water- and oil-repellency, and into which a water- and oil-repellent is incorporated.

We intensively studied the incorporation of a water- and oil-repellent into a fiber and found that a specific fluorine-containing compound has suitable compatibility with a synthetic resin forming the fiber and exhibits excellent water- and oil-repellency which continues for a long time.

The present invention provides a water- and oil-repellent fiber comprising a synthetic resin composition which contains a fluorine-containing polymer comprising (a) a repeating unit of the formula:

$$-(OCH\underset{\displaystyle R_fX}{\underset{|}{C}}H_2)-$$

wherein $R_f$ is a perfluoroalkyl group or perfluoroalkenyl group having 3 to 21 carbon atoms, X is a direct bond, $-CH_2-$, $-CH_2OCH_2-$, $-CH_2CH_2OCH_2-$, $-(CH_2)_6OCH_2-$, $-CH{=}CHCH_2OCH_2-$, $-CH_2CHICH_2OCH_2-$, $-COOCH_2-$, $-CH_2COOCH_2-$, $-SO_2N(R')CH_2COOCH_2-$ or $-SO_2N(R')CH_2CH_2OCH_2-$ (R' is a lower alkyl group).

DETAILED DESCRIPTION OF THE INVENTION

In the present invention, the fluorine-containing polymer may have, in addition to the repeating unit (a), at least one specified repeating unit selected from the group consisting of (b) a repeating unit of the formula:

$$-(\underset{\displaystyle O}{\underset{\|}{C}}-R-\underset{\displaystyle O}{\underset{\|}{C}})-$$

wherein R is a group which remains after removing $$-\underset{\displaystyle O}{\underset{\|}{C}}-O-\underset{\displaystyle O}{\underset{\|}{C}}-$$

from a cyclic acid anhydride, (c) a repeating unit of the formula:

$$-(OCR^1R^2CR^3R^4)-$$

wherein each of $R^1$, $R^2$, $R^3$ and $R^4$ is a hydrogen atom, an alkyl group, an alkyl group having a substituent group, an aryl group, or an aryl group having a substituent group, (d) a repeating unit of the formula:

$$-[N\underset{\displaystyle O=C-R^5}{\underset{|}{(CH_2)_m}}]-$$

wherein $R^5$ is a hydrogen atom, an alkyl group or an aryl group, and m is 2 or 3, (e) a repeating unit of the formula:

$$-OCH_2-A^1-$$

wherein $A^1$ is $-(CH_2)_p-$ or $-CR^6R^7CH_2-$ (p is an integer of 2 to 10, and each of $R^6$ and $R^7$ is $-CH_3$, $-CH_2Cl$, $-CH_2F$, $-CH_2OCH_3$, $-CH_2OC_2H_5$, $-CH_2OCOCH_3$, $-CH_2OC_6H_5$, $-CH_2OH$, $-CH_2CN$ or $-H$($R^6$ and $R^7$ are not simultaneously $-H$)), and (f) a repeating unit of the formula:

$$-OCH_2-A^2-$$

wherein $A^2$ is $-(OCH_2)_q-(CH_2)_r-$ or $-(OCH_2CH_2)_s-$ (q is an integer of 1 to 3, r is an integer of 1 to 8 when q is 1, or an integer of 0 to (12–2 q) when q is 2 or 3, and s is 2 or 3).

Namely, in the present invention, the fluorine-containing polymer comprises (1) the repeating unit (a),
(2) the repeating units (a) and (b),
(3) the repeating units (a), (b) and (c),
(4) the repeating units (a), (b) and (d),
(5) the repeating units (a), (b), (c) and (d),
(6) the repeating units (a) and (c),
(7) the repeating units (a), (c) and (e),
(8) the repeating units (a), (c) and (f), (9) the repeating units (a) and (e), or (p0 (10) the repeating nits (a) and (f).

The polymer having the repeating units (b), namely the polymers (2), (3), (4) and (5) can be referred to as "fluorine-containing polyester polymer". The polymer without the repeating unit (b), namely the polymers (1), (6), (7), (8), (9) and (10) can be referred to as "fluorine-containing polyether polymer".

In the above formulas, R' may be an alkyl group having 1 to 10 carbon atoms. With respect to $R^1$, $R^2$, $R^3$ and $R^4$, the number of carbon atoms of the alkyl group is from 1 to 5, the aryl group is preferably a phenyl group or the like, and the substituent group is an alkyl group having 1 to 2 carbon atoms, a hydroxyl group, a chlorine atom, a fluorine atom or the like. With respect to $R^5$, the number of carbon atoms of the alkyl group is preferably from 1 to 5, and the aryl group is preferably a phenyl group or the like.

Since, in the present invention, the fluorine-containing polymer is incorporated in the synthetic fiber, the fluorine-containing polymer bleeds and is concentrated on a fiber surface at the step of the spinning of the fiber so that the fiber can have water- and oil-repellency. Of course, a yarn and a fabric (for example, a woven fabric and a non-woven fabric) formed from the fiber according to the present invention also have water- and oil-repellency.

The present invention has following effects in addition to the excellent water- and oil repellency: (i) The fabric has a stainproof property. (ii) The fiber surface has a lubricating property due to the perfluoroalkyl group or the perfluoroalkenyl group so that a feeling of the fabric is improved.

A number average molecular weight of the fluorine-containing polymer can be measured by a usual method such as a gel permeation chromatography and is usually from 1,000 to 100,000, preferably from 3,000 to 30,000.

When the fluorine-containing polymer contains the repeating unit (b), the amount of the repeating unit (b) is usually at most 9 moles, preferably from 0.4 to 6 moles, more preferably from 0.6 to 3 moles per 1 mole of the repeating unit (a). The repeating unit (b) gives good solubility or dispersibility in a solvent.

When the fluorine-containing polymer contains the repeating unit (c), the amount of the repeating unit (c) is usually at most 8 moles, preferably from 0.1 to 5 moles, more preferably from 0.2 to 2 moles per 1 mole of the repeating unit (a). The repeating unit (c) gives an easy synthesis of the polymer and an improved affinity for the synthetic resin.

When the fluorine-containing polymer contains the repeating unit (d), the amount of the repeating unit (d) is usually at most 8 moles, preferably from 0.1 to 5 moles, more preferably from 0.1 to 2 moles per 1 mole of the repeating unit (a). The repeating unit (d) gives an improved affinity for the synthetic resin.

When the fluorine-containing polymer contains the repeating unit (e), the amount of the repeating unit (e) is usually at most 9 moles, preferably from 0.1 to 6 moles, more preferably from 0.2 to 3 moles per 1 mole of the repeating unit (a). The repeating unit (e) gives good solubility or dispersibility in a solvent and an improved affinity for the synthetic resin.

When the fluorine-containing polymer contains the repeating unit (f), the amount of the repeating unit (f) is usually at most 9 moles, preferably from 0.1 to 6 moles, more preferably from 0.2 to 3 moles per 1 mole of the repeating unit (a). The repeating unit (f) gives good solubility or dispersibility in a solvent and an improved affinity for the synthetic resin.

In the fluorine-containing polymers (2)–(10), the amount of the repeating unit (a) is usually at least 10% by mole, preferably at least 25% by mole based on the total repeating units of the polymer. If the amount of the repeating unit (a) is smaller than 10% by mole, the water- and oil-repellency is insufficient.

The repeating unit (a) in the fluorine-containing polymer can be derived from, for example (a') an epoxide of the formula:

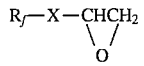

wherein $R_f$ and X are the same as defined above.

The repeating unit (b) in the fluorine-containing polymer can be derived from, for example, (b') a cyclic acid anhydride of the formula:

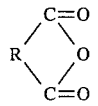

wherein R is the same as defined above.

The repeating unit (c) in the fluorine-containing polymer can be derived from, for example, (c') an epoxide of the formula:

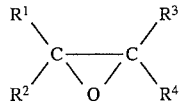

wherein $R^1$, $R^2$, $R^3$ and R4 are the same as defined above.

The repeating unit (d) in the fluorine-containing polymer can be derived from, for example, (d') a cyclic iminoether of the formula:

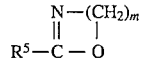

wherein $R^5$ and m are the same as defined above.

The repeating unit (e) in the fluorine-containing polymer can be derived from, for example, (e') a cyclic ether of the formula:

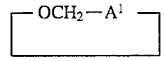

wherein $A^1$ is the same as defined above.

The repeating unit (f) in the fluorine-containing polymer can be derived from, for example, (f') a cyclic formula of the formula:

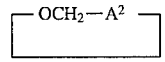

wherein $A^2$ is the same as defined above.

The fluorine-containing polymer according to the present invention can be prepared by polymerizing the monomer (a') alone, or the monomer (a') and at least one of monomers (b')–(f').

The fluorine-containing polymer itself used in the present invention is conventionally known. The preparation of the fluorine-containing polyester polymer is described in, for example, Japanese Patent Kokai Publication No. 139696/1978 (corresponding to U.S. Pat. No. 4,250,300, the disclosure of which is incorporated herein by reference.) and Japanese Patent Kokai Publication 139697/1978 (corresponding to U.S. Pat. No. 4,182,846, the disclosure of which is incorporated herein by reference.). The fluorine-containing polyester polymer can be basically prepared by the copolymerization, particularly the alternating polymerization of the epoxide (the epoxide (a') and the optionally used epoxide (c')) and the cyclic acid anhydride (b'). The preparation of the fluorine-containing polyether polymer is described in, for example, Japanese Patent Kokai Publication No. 215023/1985 (corresponding to U.S. Pat. No. 4,563,493, the disclosure of which is incorporated herein by reference.). The fluorine-containing polyether polymer can be basically prepared by the ring opening polymerization of the epoxide (the epoxide (a') and the optionally used epoxide (c')). Other compounds (for example, the cyclic iminoether (d'), the cyclic ether (e'), the cyclic formula (f') and the like) may be copolymerized for the preparation of any of the above polymers, if the copolymerization can be conducted.

A polymerization reaction can be conducted with heating the monomer in the presence of a catalyst. The polymerization may be a bulk polymerization, a solution polymerization, a non-water emulsion polymerization, a non-water suspension polymerization or the like.

The catalyst may be various compounds. A cationic polymerization catalyst (for example, boron trifluoride, a boron trifluoride/diethyl ether complex, tin tetrachloride, aluminum trichloride, a metal halide and the like), an anionic polymerization catalyst (for example, an alkaline metal, an amine and the like), a coordination anionic polymerization catalyst (for example, a trialkylaluminum, dialkylzinc, phosphoric acid and the like) and the like which are known to be active to the ring opening polymerization of an epoxide can be used. An alkaline metal halide, an alkali hydroxide, an amine, an alkyl metal compound and phosphine and the like which are known to be active to the copolymerization of an epoxide and a cyclic acid anhydride can be also used. The amount of the catalyst is usually from 0 to 10 parts by weight per 100 parts by weight of the monomer. A cocatalyst which is, for example, water, an alcohol, an acid, an ether, an alkyl halide or the like may be used.

A polymerization temperature is not limited and can be suitably selected according to the reactivity of each monomer. The polymerization temperature is usually from 0° to 200° C., preferably from 50° to 150° C. A solvent is not necessarily used for the polymerization, and it is used for a convenience of the reaction such as a reaction temperature control. The polymerization solvent can be selected from the various solvents which are inactive to the used monomer, and may be dimethylformamide, acetonitrile, benzene or the like.

Specific examples of the monomer (a') are

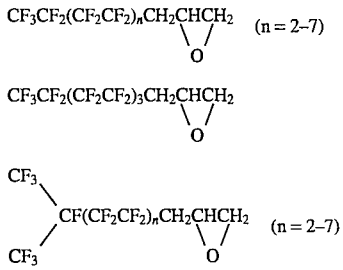

-continued

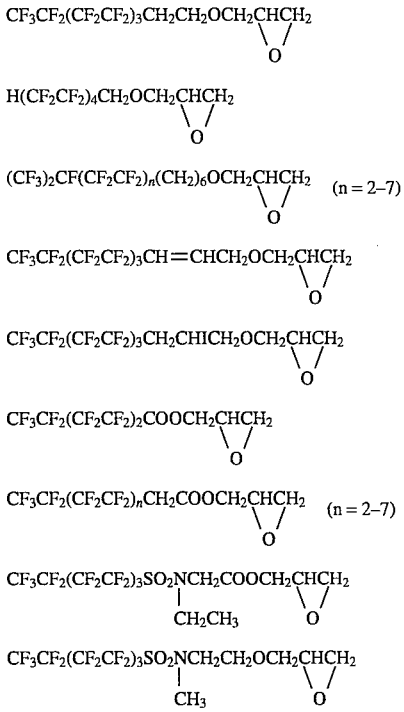

2-perfluoroalkyl-1,2-epoxyethane and the like.

The preferable monomer (b') is a five-membered cyclic compound formed by the dehydration of two carboxyl groups of a dicarboxylic acid formed by bonding one carboxyl group to each of adjacent two carbon atoms (the two carbon atoms may be bonded through a single or double bond). Specific examples of the monomer (b') are succinic anhydride, maleic anhydride, phthalic anhydride, pyromellitic anhydride, 1,2-cyclohexanedicarboxylic anhydride, tetrahydrophthalic anhydride, 1,2,3,4-cyclopentanetetracarboxylic dianhydride, 1,2-cyclobutanedicarboxylic anhydride, endomethylene tetrahydrophthalic anhydride, 1,2-naphthalenedicarboxylic anhydride, 2,3-naphthalenedicarboxylic anhydride, glutaric anhydride and the like.

Specific examples of the monomer (c') are ethylene oxide, propylene oxide, isobutylene oxide, butadiene oxide, styrene oxide, an epihalogenhydrin such as epichlorohydrin, an alkyl or aryl glycicyl ether such as methyl glycicyl ether, phenyl glycicyl ether and the like.

Specific examples of the monomer (d') are 2-oxazoline, 2-methyl-2-oxazoline, 5,6-dihydro-4H-1,3-oxazine, substituted derivatives thereof and the like.

Specific examples of the cyclic ether (e') are oxetane, tetrahydrofuran, tetrahydropyran, 3,3-bis(chloromethyl)oxetane, substituted derivatives thereof and the like.

Specific examples of the cyclic formal (f') are 1,3-dioxolane, trioxane, tetraoxane, 1,3,6-trioxocane, 1,3,5-trioxocane, substituted derivatives thereof and the like.

The water- and oil-repellent fiber according to the present invention can be generally prepared by mixing a synthetic resin forming the fiber with the fluorine-containing polymer and then spinning the resin to form the fiber. The synthetic resin may be any of resins. Specific examples of the synthetic resin are a polyester resin, a nylon resin, an acrylic resin, a urethane resin, a polyolefin resin, a polyvinylalcohol resin, a vinyl chloride resin, a vinylidene chloride resin and the like. The amount of the fluorine-containing polymer is usually from 0.1 to 30 parts by weight, preferably from 5 to 20 parts by weight per 100 parts by weight of the synthetic resin. The synthetic resin composition may contain an additional additive, for example, a compatibilizing agent, a melt viscosity controlling agent, an antistatic agent, a fungicide, a flame retardant and the like. The amount of the additional additive is usually at most 50 parts by weight, preferably from 0.1 to 20 parts by weight per 100 parts by weight of the synthetic resin.

A procedure for mixing the synthetic resin with the fluorine-containing polymer includes (1) melting each of the synthetic resin powder and the polymer powder and mixing the resultant melts;

(2) adding the polymer powder to the molten synthetic resin and mixing them;

(3) adding the polymer powder to the synthetic resin powder and mixing them by a mixing apparatus such as a mixer;

(4) coating the molten polymer on the synthetic resin powder or pellets;

(5) coating a dispersion or solution of the polymer in water or a solvent on the synthetic resin powder or pellets and then evaporating water or the solvent; and the like. Any of the above mixing procedures can be used. The synthetic resin may be spun after the mixing by the above procedures. Alternatively, the polymer is coated on an unstretched yarn of the synthetic resin so that the polymer impregnates in an internal portion of the yarn. Further, the polymer and the synthetic resin subjected to a conjugate spinning are combined by a splicing, a core/cladding, polydispersion or the like.

In order to spin the synthetic resin composition containing the fluorine-containing polymer, any of the conventional procedures for the spinning can be used. The composition can be spun by, for example, a melt spinning, a dry spinning or a wet spinning. In addition, the composition can be spun by an emulsion spinning, a conjugate spinning, a non-woven fabric spinning (for example, a spun bond method, a melt blown method and a flash method) or the like. When the mixing is conducted by the procedures (3), (4) and (5), the synthetic resin and the fluorine-containing polymer are fully mixed during the spinning.

At least two of the fluorine-containing polymers can be used.

PREFERRED EMBODIMENT OF THE INVENTION

The present invention will be illustrated by the following Examples which do not limit the present invention.

Properties of the fabric were evaluated according to the following methods.

1) Water-repellency

The water-repellency is expressed by the water-repellency No. by a spray method according to JIS (Japanese Industrial Standard) L-1005. The larger the water-repellency No. is, the better the water-repellency is.

2) Oil-repellency

The oil-repellency is expressed by the oil-repellency No. based on the impregnation of each sample liquid according to AATCC 118. The larger the oil-repellency No. is, the better the oil repellency is.

3) Stain resistance

A sample fabric was cut into a 6 cm×6 cm size piece, and was charged in a vessel together with a dry soil which was a homogeneous mixture having the following composition. The content in the vessel was vigorously mixed for 3 minutes, and a residual stain of the sample fabric was removed by an electrical vacuum cleaner. The brightness of the fabric was determined by a generally used differential colorimeter. A degree of contamination was calculated from the following equation. The stain resistance is expressed by the degree of contamination.

$$\text{Degree of contamination } (\%) = (R_0 - R)/R_0 \times 100$$

($R_0$: Brightness of uncontaminated fabric,

R: Brightness of contaminated fabric)

Composition of dry soil

| Material | wt % |
|---|---|
| Peat moss | 38 |
| Cement | 17 |
| Kaolin clay | 17 |
| Silica | 17 |
| Carbon black | 1.75 |
| Ferric oxide | 0.50 |
| Mineral oil | 8.75 |

4) Feeling

The feeling was determined according to the feel of the fabric.

Good: The feeling is good.

Bad: The feeling is bad.

5) Durability

The sample fabric was rubbed 1,000 times by a gakushin-type friction tester. The durability was expressed by the evaluation of the oil-repellency of a rubbed part.

Preparative Example 1

Preparation of polymer A

A mixture of an epoxide (56 moles) of the formula:

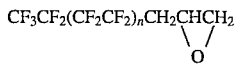

(a mixture of 1% by a mole of a compound wherein n is 2, 64% by mole of a compound wherein n is 3, 25% by mole of a compound wherein n is 4, 7% by mole of a compound wherein n is 5, 2% by mole of a compound wherein n is 6 and 1% by mole of a compound wherein n is 7), succinic anhydride (30 moles) and phthalic anhydride (14 moles) were charged under the nitrogen atmosphere in a flask equipped with a stirring mechanism and a reflux condenser. A catalyst, N,N-dimethylbenzylamine (0.5 moles) was added to the flask and the mixture was stirred at 140° C. for 4 hours to give a polymer. The polymer contained 56.2% by mole of a repeating unit derived from the epoxide, 30.3% by mole of a repeating unit derived from succinic anhydride and 13.5% mole of a repeating unit derived from phthalic anhydride. Softening point: 48° C. Molecular weight: 7,000.

Preparative Example 2

Preparation of polymers B–G

Fluorine-containing polyester polymers B–G were prepared in the same manner as in Preparative Example 1 except that the monomers shown in Table 1 were used. The compositions and molecular weights of the polymers B–G are shown in Table 1.

TABLE 1

| Polymer | Monomer | Molar ratio (%) | Number average molecular weight |
|---|---|---|---|
| A | Epoxide [1] | 56 | 7,000 |
| | Succinic anhydride | 30 | |
| | Phthalic anhydride | 14 | |
| B | Epoxide [2] | 56 | 5,500 |
| | Phthalic anhydride | 28 | |
| | Pyromellitic anhydride | 16 | |
| C | Epoxide [1] | 33.4 | 12,000 |
| | Succinic anhydride | 33.3 | |
| | 2-Methyl-2-oxazoline | 33.3 | |
| D | Epoxide [1] | 29 | 8,000 |
| | Phthalic anhydride | 47 | |
| | Phenyl glycidyl ether | 24 | |
| E | Epoxide [2] | 34 | 8,500 |
| | Phthalic anhydride | 50 | |
| | Epichlorohydrin | 16 | |
| F | Epoxide [2] | 25 | 15,000 |
| | Maleic anhydride | 50 | |
| | Styrene oxide | 25 | |
| G | Epoxide [1] | 33 | 10,000 |
| | Phthalic anhydride | 48 | |
| | Phenyl glycidyl ether | 14 | |
| | 2-Methyl-2-oxazoline | 5 | |

Note)

Epoxide [1]: $CF_3CF_2(CF_2CF_2)_nCH_2\underset{\diagdown O \diagup}{CHCH_2}$ (a mixture consisting of 1% by mole of a compound wherein n is 2, 64% by mole of a compound wherein n is 3, 25% by mole of a compound wherein n is 4, 7% by mole of compound wherein n is 5, 2% by mole of a compound wherein n is 6 and 1% by mole of a compound wherein n is 7)

Epoxide [2]: $CF_3CF_2(CF_2CF_2)_3CH_2\underset{\diagdown O \diagup}{CHCH_2}$

Preparative Example 3

Preparation of polymer H

An epoxide (100 g) of the formula:

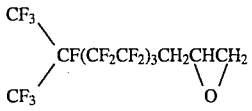

was charged under the nitrogen atmosphere in a flask equipped with a stirring mechanism and a reflux condenser. After the content in the flask was heated to 100° C., a catalyst, $BF_3O(C_2H_5)$(1.0 g) was added to the flask and the mixture was reacted for 4 hours. A resultant polymer H had a number average molecular weight of 11,000.

Preparative Example 4

Preparation of polymers I–O

Fluorine-containing polyether polymers I–O were prepared in the same manner as in Preparative Example 3 except that the monomers shown in Table 2 were used. The compositions and molecular weights of the polymers I–O are shown in Table 2.

TABLE 2

| Polymer | Monomer | Molar ratio (%) | Number average molecular weight |
|---|---|---|---|
| H | Epoxide [3] | 100 | 11,000 |
| I | Epoxide [1] | 100 | 10,000 |
| J | Epoxide [2] | 67 | 13,000 |
| | Tetrahydrofuran | 33 | |
| K | Epoxide [1] | 50 | 9,500 |
| | 1,3-Dioxolane | 50 | |
| L | Epoxide [1] | 70 | 11,000 |
| | Phenyl glycidyl ether | 15 | |
| | Tetrahydrofuran | 15 | |
| M | Epoxide [2] | 25 | 9,000 |
| | Epichlorohydrin | 15 | |
| | Tetrahydrofuran | 60 | |
| N | Epoxide [2] | 60 | 12,000 |
| | Phenyl glycidyl ether | 40 | |
| O | Epoxide [1] | 40 | 13,000 |
| | Epichlorohydrin | 40 | |
| | Trioxane | 20 | |

Note)

Epoxides [1] and [2] are the same as defined above.

Epoxide [3]: $\begin{matrix} CF_3 \diagdown \\ \quad CF(CF_2CF_2)_3CH_2\underset{\diagdown O \diagup}{CHCH_2} \\ CF_3 \diagup \end{matrix}$

Example 1

Powder of the fluorine-containing polymer (additive) was added to synthetic resin pellets and the mixing was conducted by an extruder during the extrusion to form pellets. A generally used polyester resin was used as the synthetic resin and the polymer A was used as the additive. The amount of the additive was 5 parts by weight per 100 parts by weight of the synthetic resin. The pellets were stretched while extruded by a biaxial extruder at 300° C. to prepare a fiber having 200 denier. This fiber was woven by a plain weave to form a woven fabric. The woven fabric was subjected to the water-repellency test, the oil-repellency test, the stain resistance test, the feeling test and the durability test. The results are shown in Table 3.

Examples 2 to 26

The same procedure as in Example 1 was repeated except that the types and amounts of the polymers (the additives) shown in Table 3 were used and the types of the synthetic resins were used. The results are shown in Table 3.

Comparative Examples 1 to 7

The same procedure as in Example 1 was repeated except that the additives shown in Table 4 and the synthetic resins shown in Table 4 were used. The results are shown in Table 4.

TABLE 3

| Ex. No. | Additive | Addition amount (PHR) | Resin | Water-repellency | Oil-repellency | Stain resistance | Feeling | durability |
|---|---|---|---|---|---|---|---|---|
| 1 | A | 5 | Polyester | 100 | 6 | 12 | Good | 5 |
| 2 | A | 20 | Polyester | 100 | 7 | 5 | Good | 7 |
| 3 | A | 5 | Nylon | 100 | 7 | 8 | Good | 6 |
| 4 | B | 5 | Polyester | 100 | 5 | 15 | Good | 5 |
| 5 | C | 5 | Nylon | 100 | 6 | 10 | Good | 6 |
| 6 | C | 5 | Urethane | 90 | 5 | 9 | Good | 4 |
| 7 | D | 1 | Polyester | 90 | 5 | 17 | Good | 3 |
| 8 | D | 5 | Polyester | 100 | 6 | 10 | Good | 6 |
| 9 | D | 5 | Nylon | 100 | 7 | 6 | Good | 6 |
| 10 | E | 5 | Acryl | 100 | 6 | 18 | Good | 6 |
| 11 | E | 10 | Nylon | 100 | 6 | 8 | Good | 6 |
| 12 | F | 5 | Polyester | 90 | 6 | 15 | Good | 5 |
| 13 | F | 5 | Acryl | 100 | 5 | 18 | Good | 4 |
| 14 | G | 5 | Polyester | 100 | 7 | 12 | Good | 6 |
| 15 | G | 10 | Nylon | 100 | 6 | 6 | Good | 5 |
| 16 | H | 10 | Nylon | 100 | 7 | 6 | Good | 6 |
| 17 | I | 5 | Polyester | 100 | 7 | 12 | Good | 7 |
| 18 | I | 5 | Nylon | 100 | 7 | 7 | Good | 6 |
| 19 | J | 10 | Polyester | 100 | 7 | 9 | Good | 7 |
| 20 | J | 5 | Acryl | 100 | 6 | 16 | Good | 5 |
| 21 | K | 10 | Polyester | 100 | 6 | 11 | Good | 5 |
| 22 | L | 5 | Acryl | 100 | 6 | 15 | Good | 6 |
| 23 | L | 1 | Polyester | 90 | 6 | 15 | Good | 5 |
| 24 | M | 5 | Nylon | 90 | 5 | 10 | Good | 4 |
| 25 | N | 5 | Polyester | 100 | 6 | 13 | Good | 5 |
| 26 | O | 5 | Polyester | 100 | 6 | 11 | Good | 5 |

TABLE 4

| Com. Ex. No. | Additive | Addition amount (PHR) | Resin | Water-repellency | Oil-repellency | Stain resistance | Feeling | durability |
|---|---|---|---|---|---|---|---|---|
| 1 | None | 0 | Polyester | 0 | 0 | 25 | Good | — |
| 2 | None | 0 | Nylon | 0 | 0 | 30 | Good | — |
| 3 | None | 0 | Acryl | 0 | 0 | 20 | Good | — |
| 4 | None | 0 | Urethane | 0 | 0 | 28 | Good | — |
| 5 | X | 5 | Polyester | 80 | 4 | 12 | Good | 3 |
| 6 | Y | 5 | Polyester | 100 | 6 | 20 | Bad | 4 |
| 7 | Z | 5 | Nylon | 90 | 5 | 17 | Bad | 3 |

Note)
Additive X:

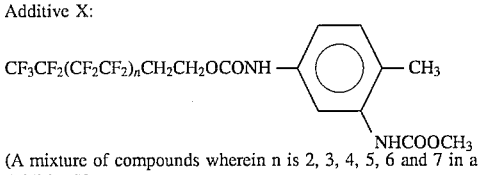

(A mixture of compounds wherein n is 2, 3, 4, 5, 6 and 7 in a molar ratio of 1:64:25:7:2:1)
Additive Y:
Copolymer of $CF_3CF_2(CF_2CF_2)_nCH_2CH_2OCOCH{=}CH_2$ and $CH_2{=}CHCl$ (molar ratio: 2:1)
(A mixture of compounds wherein n is 2, 3, 4, 5, 6 and 7 in a molar ratio of 1:64:25:7:2:1)
Molecular weight 100,000
Additive Z:

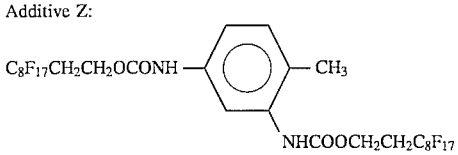

EFFECTS OF THE INVENTION

The fiber according to the present invention gives a fabric having excellent water- and oil-repellency, excellent stain resistance and excellent feeling. The excellent water- and oil-repellency continues for a long time.

What is claimed is:

1. A water- and oil-repellent fiber comprising a synthetic resin composition which contains a fluorine-containing polymer comprising (a) a repeating unit of the formula:

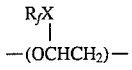

wherein $R_f$ is a perfluoroalkyl group or perfluoroalkenyl group having 3 to 21 carbon atoms, and X is a direct bond, $—CH_2—$, $—CH_2OCH_2—$, $—CH_2CH_2OCH_2—$, $—(CH_2)_6OCH_2—$, $—CH=CHCH_2OCH_2—$, $—CH_2CHICH_2OCH_2—$, $—COOCH_2—$, $—CH_2COOCH_2—$, $—SO_2N(R')CH_2COOCH_2—$ or $—SO_2N(R')CH_2CH_2OCH_2—$, wherein R' is an alkyl group, and wherein said fluorine-containing polymer is incorporated into said synthetic resin composition such that said fluorine-containing polymer is not coated on said fiber.

2. The water- and oil repellent fiber according to claim 1, wherein the fluorine-containing polymer further contains (b) a repeating unit of the formula:

$$-(\underset{\underset{O}{\|}}{C}-R-\underset{\underset{O}{\|}}{C})-$$

wherein R is a group which remains after removing $$-\underset{\underset{O}{\|}}{C}-O-\underset{\underset{O}{\|}}{C}-$$

from a cyclic acid anhydride, in addition to the repeating unit (a).

3. The water- and oil-repellent fiber according to claim 2, wherein the fluorine-containing polymer further contains either or both of (c) a repeating unit of the formula:

$$-(OCR^1R^2CR^3R^4)-$$

wherein each of $R^1$, $R^2$, $R^3$ and $R^4$ is a hydrogen atom, an alkyl group, an alkyl group having a substituent group, an aryl group, or an aryl group having a substituent group, and (d) a repeating unit of the formula:

$$-[\underset{\underset{O=C-R^5}{|}}{N}(CH_2)_m]-$$

wherein $R^5$ is a hydrogen atom, an alkyl group or an aryl group, and m is 2 or 3, in addition to the repeating units (a) and (b).

4. The water- and oil-repellent fiber according to claim 1, wherein the fluorine-containing polymer further contains (c) a repeating unit of the formula:

$$-(OCR^1R^2CR^3R^4)-$$

wherein each of $R^1$, $R^2$, $R^3$ and $R^4$ is a hydrogen atom, an alkyl group, an alkyl group having a substituent group, an aryl group, or an aryl group having a substituent group, in addition to the repeating unit (a).

5. The water- and oil-repellent fiber according to claim 4, wherein the fluorine-containing polymer further contains either (e) a repeating unit of the formula:

$$—OCH_2—A^1—$$

wherein $A^1$ is $—(CH_2)_p—$ or $—CR^6R^7CH_2—$; p is an integer of 2 to 10; and each of $R^6$ and $R^7$ is $—CH_3$, $—CH_2Cl$, $—CH_2F$, $—CH_2OCH_3$, $—CH_2OC_2H_5$, $—CH_2OCOCH_3$, $—CH_2OC_6H_5$, $—CH_2OH$, $—CH_2CN$ or —H, provided that $R^6$ and $R^7$ are not simultaneously —H, or (f) a repeating unit of the formula:

$$—OCH_2—A^2—$$

wherein $A^2$ is a $—(OCH_2)_q—(CH_2)_r—$ or $—(OCH_2CH_2)_s—$; q is an integer of 1 to 3; r is an integer of 1 to 8 when q is 1, or an integer of 0 to 12 when q is 2 or 3; and s is 2 or 3, in addition to the repeating units (a) and (c).

6. The water- and oil-repellent fiber according to claim 1, wherein the fluorine-containing polymer further contains either (e) a repeating unit of the formula:

$$—OCH_2—A^1—$$

wherein $A^1$ is $—(CH_2)_p—$ or $—CR^6R^7CH_2—$; p is an integer of 2 to 10; and each of $R^6$ and $R^7$ is $—CH_3$, $—CH_2Cl$, $—CH_2F$, $—CH_2OCH_3$, $—CH_2OC_2H_5$, $—CH_2OCOCH_3$, $—CH_2OC_6H_5$, $—CH_2OH$, $—CH_2CN$ or —H, provided that $R^6$ and $R^7$ are not simultaneously —H, or (f) a repeating unit of the formula:

$$—OCH_2—A^2—$$

wherein $A^2$ is a $—(OCH_2)_q—(CH_2)_r—$ or $—(OCH_2CH_2)_s—$; q is an integer of 1 to 3; r is an integer of 1 to 8 when q is 1, or an integer of 0 to 12 when q is 2 or 3; and s is 2 or 3, in addition to the repeating unit (a).

7. The water- and oil-repellent fiber according to anyone of claims 1 to 6, wherein the synthetic resin composition contains the fluorine-containing polymer in an amount of 0.1 to 30 parts by weight per 100 parts by weight of a synthetic resin.

8. The water- and oil-repellent fiber according to claim 1, wherein R' is an alkyl group having 1 to 10 carbon atoms.

9. The water- and oil-repellent fiber according to claim 3, wherein each of $R^1$, $R^2$, $R^3$ and $R^4$ is a hydrogen atom, an alkyl group with 1 to 5 carbon atoms, a phenyl group, or an alkyl group with 1 to 5 carbon atoms having a substituent group selected from the group consisting of an alkyl group with 1 to 2 carbon atoms, a hydroxyl group, a chlorine atom and a fluorine atom.

10. The water- and oil-repellent fiber according to claim 3, wherein $R^5$ is a hydrogen atom, an alkyl group with 1 to 5 carbon atoms or a phenyl group.

11. The water- and oil-repellent fiber according to claim 2, wherein repeating unit (b) is present in an amount of 0.6 to 3 moles per one mole of repeating unit (a).

12. The water- and oil-repellent fiber according to claim 3, wherein repeating unit (c) is present in an amount of 0.2 to 2 moles per one mole of repeating unit (a); and repeating unit (d) is present in an amount of 0.1 to 2 moles per one mole of repeating unit (a).

13. The water- and oil-repellent fiber according to claim 3, wherein repeating unit (c) is present in an amount of from 0.2 to 2 moles per one mole of repeating unit (a).

14. The water- and oil-repellent fiber according to claim 6, wherein repeating units (e) and (a) are present in said fiber, and wherein repeating unit (e) is present in an amount of from 0.2 to 3 moles per one mole of repeating unit (a).

15. The water- and oil-repellent fiber according to claim 6, wherein repeating units (f) and (a) are present in said fiber, and wherein repeating unit (f) is present in an amount of from 0.2 to 3 moles per one mole of repeating unit (a).

* * * * *